US005800157A

United States Patent [19]

Hasse et al.

[11] Patent Number: 5,800,157

[45] Date of Patent: Sep. 1, 1998

[54] GAS BURNER HAVING A BURNER PLATE MADE OF FIBROUS MATERIAL AND WITH REDUCED SOUND GENERATION

[75] Inventors: Reiner Ulrich Hasse, Mainz; Michael Kahlke, Bingen, both of Germany

[73] Assignee: Schott Glaswerke, Mainz, Germany

[21] Appl. No.: 760,991

[22] Filed: Dec. 5, 1996

[30] Foreign Application Priority Data

Dec. 6, 1995 [DE] Germany ..... 195 45 504.5

[51] Int. Cl.[6] ..... F23D 14/12

[52] U.S. Cl. ..... 431/328

[58] Field of Search ..... 431/328, 329

[56] References Cited

U.S. PATENT DOCUMENTS

| | | | |
|---|---|---|---|
| 3,173,470 | 3/1965 | Wright | 431/328 |
| 4,500,283 | 2/1985 | Smith | 431/328 |
| 4,673,349 | 6/1987 | Abe . | |
| 5,046,944 | 9/1991 | Smith | 431/328 |
| 5,114,284 | 5/1992 | Keizer et al. | 431/328 |

FOREIGN PATENT DOCUMENTS 2440701 11/1978 Germany .

*Primary Examiner*—Carroll B. Dority
*Attorney, Agent, or Firm*—Michael J. Striker

[57] ABSTRACT

The gas burner according to the invention has a burner chamber housing, a mixing pipe connected to the burner chamber housing for supplying a gas/air mixture, a burner plate made of fibrous material and attached to the burner chamber housing at edge regions of the burner plate, a blower for supplying air to make the gas/air mixture, and advantageously an ignition device, a safety device and a temperature monitoring device. A central region of the burner plate is advantageously directly or indirectly connected to a corresponding central region of the burner chamber housing to suppress burner plate vibration during start-up of burner operation to prevent sound generation during the start-up and minimize the pressure drop in the burner chamber. In a preferred embodiment a recessed portion formed in a middle region of a base plate of the burner chamber housing is shaped to contact on a central region of the burner plate and a temperature-resistant adhesive is used to connect the burner plate and the recessed portion of the burner chamber housing.

4 Claims, 2 Drawing Sheets

GAS BURNER HAVING A BURNER PLATE MADE OF FIBROUS MATERIAL AND WITH REDUCED SOUND GENERATION

BACKGROUND OF THE INVENTION

The present invention concerns a gas burner with a metal housing as burner chamber, a mixing pipe for admission of the gas/air mixture to the burner chamber, a burner plate made of fibrous material, a regulating device for the gas supply, a blower for the air supply and the standard ignition, safety and temperature monitoring devices.

Gas burners for use in heaters, hot water boilers and drying apparatuses are know. These burners are generally common in cooking units. For example, a gas hearth with several cooking burners, which are formed as gas burners with perforated ceramic plates, on whose upper surface the gas burns without a flame, is described in German Patent DE 24 40 701 C3. These gas burners are arranged underneath a glass-ceramic plate which is common for all the burners. The space surrounding the burners is thus closed on all sides of the opening spaced from the gas hearth operation side for exhaust of the burned gases and up to the outside of the glass-ceramic plate. Each burner has an ignition device which can be operated from the exterior and has an ignition safety device for prevention of emission of unburned gases. The invention of this reference is characterized by a reduced spacing of about 10 mm to 15 mm between the glass-ceramic plate and the burner surface of each burner-ceramic plate, by division of each burner into at least two chambers and by providing each of these chamber with a gas injector for drawing in combustion air.

The object of the invention described in German Patent DE 24 40 701 C3 is to provide a gas hearth which has a high operating efficiency and to maintain this high operating efficiency in spite of a good regulatability in regard to different heating requirements.

U.S. Pat. No. 4,673,349 describes a gas burner having burner plates made from porous ceramics, which have a pore volume of more than 30 vol. % and an average pore diameter of 25 to 500 μm. Furthermore these burner plates have a plurality of throughgoing ducts spaced 2 to 30 mm from teach other with a hydraulic diameter of 0.05 to 5.0 mm, which extend perpendicular to the burner surface.

The porous ceramic especially can be made from a composite material, which can contain from 2 to 50% by weight of heat treated inorganic, especially ceramic, fibers.

According to the state of the art porous, perforated ceramic plates or fiber mesh made from ceramic materials or metal are also used as burner plates. These burner plates close the top side of the mixing and/or burner chamber, in which the gas/air mixture is mixed. In the upper most layer of the burner plate small flames burn, which cause the burner plates to glow and act as heat radiators. The temperature of the heat-radiating burner plates is between about 900° and 950° C.

This type of gas burner is used also in space heating, in hot water preparation and in drying systems. Generally the entire surface of the burner plate is brought to a glow; an inner circular disk and a separate outer annular burner are operable only in two-cycle burners.

It is disadvantageous in gas burners having burner plates made from fiber material that an acoustic phenomenon occurs which is clearly detectable as a loud hum by the user during the start up phase of operation of the burner, i.e. in the first 15 seconds after ignition. This hum produces of course no safety risk, however it does effect the lifetime of the burner plate and the serviceability.

This hum phenomenon arises because of the following events. The gas is forced through an orifice in a mixing tube or pipe. Because of the high speed of the gas a lower pressure in comparison to the surrounding atmosphere develops, whereby air is sucked into the mixing pipe. This gas/air mixture flows into the combustion chamber, passes through and is uniformly distributed by the burner plate and is ignited on its top side. The burners plate acts then as the flame holder, fixing the flames on the top side of the burner plate. The flames therefore feed energy to the burner plate. This is enough to bring the upper fiber layers of the burner plate to a glow. The radiant heat energy produced in this way can now be supplied to the medium to be heated.

During the start-up phase of the burner operation, i.e. inside of the first 15 seconds after ignition, however no optimum gas/air mixture is present. That is, shortly after the gas valve is opened and the gas fed to the mixing pipe, an oxygen-containing air column is forced first into the burner, before the gas/air mixture reaches its optimum mixture ratio and subsequent uniform mixing occurs at the burner plate. In his start-up stage or phase the flames, which are cooler because of the excess air present in the mixture, initially rise from the burner plate. When the mixture is rich, i.e. the proportion of combustible gas is higher, the now hotter flames migrate back to the burner plate and deliver their energy thereto, i.e. cool there and thus again rise. This process repeats itself until the mixture is uniformly distributed and present on the burner plate with reduced air excess and the fiber temperature and the flame temperature are nearly equal. This transient vibration at a certain frequency which comprises the flames rising and/or falling causes the burner plate and with it the air column to vibrate. This vibration is in the audible range.

Currently this problem is eliminated by mounting perforated plates in the combustion chamber or burner chamber itself. These plates provide a resulting pressure drop, which is large by about a factor of 5 to 10 than the pressure drop at the burner plate itself. Because of this feature two chambers are provided with different air densities. The resulting sound waves are damped in these narrower chambers so the sound generation is prevented. This method disadvantageously causes an additional pressure drop in the burner. The blower operates against this pressure drop in order to be able to provide sufficient combustion air. This however assumes that a blower is available which can build up at least an equally high static pressure and thus has a comparatively larger size as a result.

This phenomenon occurs essentially in all radiating burners, above all however in blower supported burners. In this type of burner this effect is even comparatively stronger because in the start-up stage, in comparison to a burner operating with atmospheric air, more air is forced into the mixing pipe and because of that it takes longer to reach an optimum and uniform mixing distribution.

SUMMARY OF THE INVENTION

It is an object of the present invention to provide a simple gas burner in which transient sound generation is reduced or eliminated, which reduces the pressure drop of the entire burner to a minimum value and which, because of that, can be provided with a blower which produces sufficient combustion air but which has comparatively smaller feed power and space requirements.

According to the invention, the burner plate is attached to the burner chamber housing not only at common edge regions, but especially also in a central region of the burner plate.

It has already been shown, as above already indicated, that the burner plate itself vibrates and thus primarily and substantially contributes to the sound generation. If the vibration of the burner plate according to the invention is prevented, then the sound generation will be prevented.

The attached central region of the burner plate then does not itself radiate which however can be advantageous. In practice even a reduction of the specific output in the center of the burner is acceptable since there would otherwise be a comparatively large temperature increase in the burner center in operation. The cooking vessels used in practice sit on the edges of their base and are curved upwardly in the base center whereby a thin air cushion is produced. Because of this thin air cushion the heat conducted into the center is reduced in comparison to that at the edges and a temperature peak results when the power distribution of the burner is uniform. For this reason the burner output at the center drops in relation to the average specific output in heating elements for electrically operated cooking regions.

The attachment or connection to the burner plate with the burner chamber housing can be accomplished in several different ways according to the invention. The burner plate can be connected to the housing of the burner chamber at one central position or at several positions in the vicinity of the center of the burner plate to form the contact region from a plurality of point-like contacting locations or from at least one straight or circular contacting line. However only a maximum of about 50% of the entire surface of the burner plate can be connected with the housing, since otherwise, as in the burners with the perforated interior plates according to the art, a pressure drop will be produced which makes a comparatively higher blower power necessary.

In a preferred embodiment of the invention the burner plate is connected or attached indirectly to the burner chamber housing under comparatively gentle compression and/or by an adhesive on at least one of the contact surfaces with a material which damps vibrations or oscillations, and which thus stops the hum sound. As vibration-damping material, ceramic, glass or metal materials, especially elastic materials, such as fiber materials, which have some danger of damaging the sensitive burner plate themselves.

The diameter of the advantageously circular or annular damping member attached centrally in the burner chamber should not be less than 20 mm, especially 22 mm. The diameter of the burner chamber in this case amounts to 210 mm.

In a very much preferred embodiment of the invention the burner plate is directly attached under gentle compression with the housing of the burner chamber, by suitably shaping the housing of the burner chamber or accordingly, e.g., a "mushroom" shape for the burner plate. This latter preferred embodiment guarantees a certain special structure for this burner. Also in this embodiment it is advantageous to combine and attach the burner plate to the housing by means of an adhesive. The burner plate according to the invention comprises temperature-resistant fibers or whiskers, especially ceramic fibers of the $Al_2O_3$—$SiO_2$ system, SiC fibers or metallic fibers.

BRIEF DESCRIPTION OF THE DRAWING

The objects, features, and advantages of the invention will now be illustrated in more detail with the aid of the following description of the preferred embodiments, with reference to the accompanying figures in which.

DESCRIPTION OF THE PREFERRED EMBODIMENTS

Figure 1:
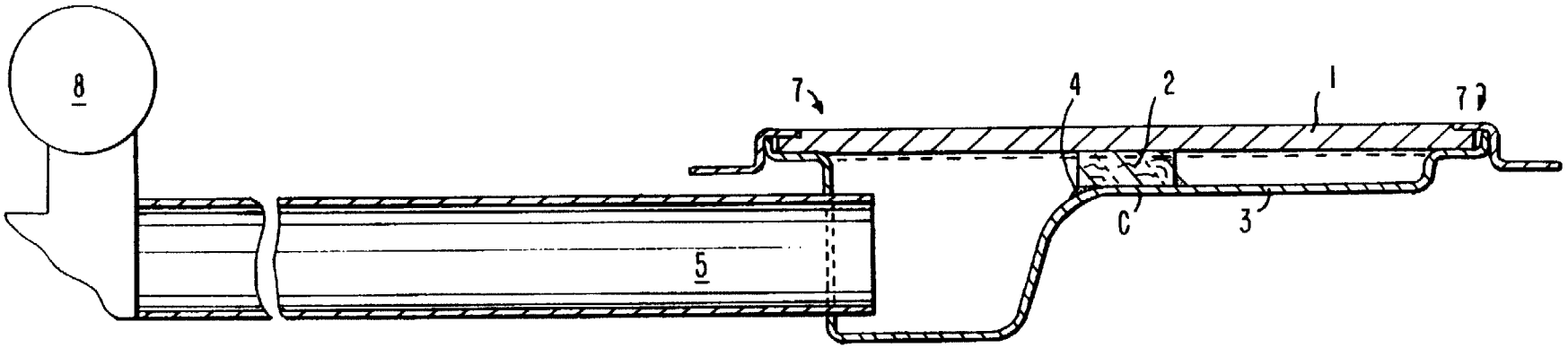
FIG. 1 is a cross-sectional view through a gas burner according to the invention.

FIG. 1 shows one embodiment of the gas burner of the invention including a burner plate 1 with a diameter of 210 mm contacting a vibration damping member 2. It has been shown that the diameter of the damping member 2 should not be smaller than 20 mm, and in the preferred embodiment 22 mm. The material should be somewhat flexible. A material made from ceramic fibers (such as ceramic fiber paper) can be used for the damping member 2. The damping member 2 is bonded with portions 4 of a temperature-resistant adhesive to a central region C of the burner chamber housing 3.

Figure 2:
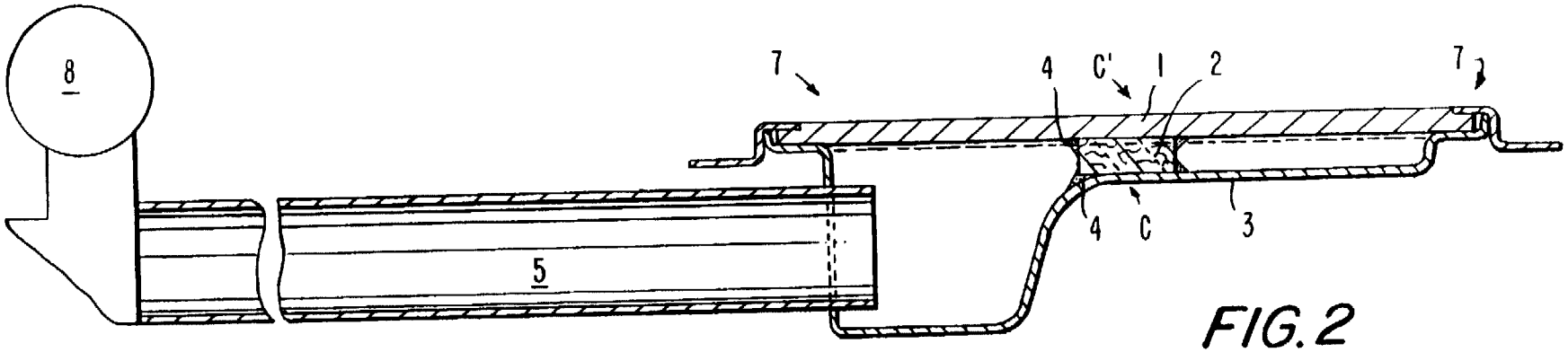
FIG. 2 is a cross-sectional view through another embodiment of a gas burner according to the invention.

FIG. 2 shows a second embodiment of a gas burner according to the invention including a burner plate 1 and a vibration or vibration damping member 2 on which a central region C' of the burner plate 1 contacts or rests. The damping member 2 in this embodiment can be made from metal or ceramic material and is bonded to both the central region C of the housing 3 and the central region C' of the burner plate 1 by portions 4 of a temperature-resistant adhesive.

Figure 3:
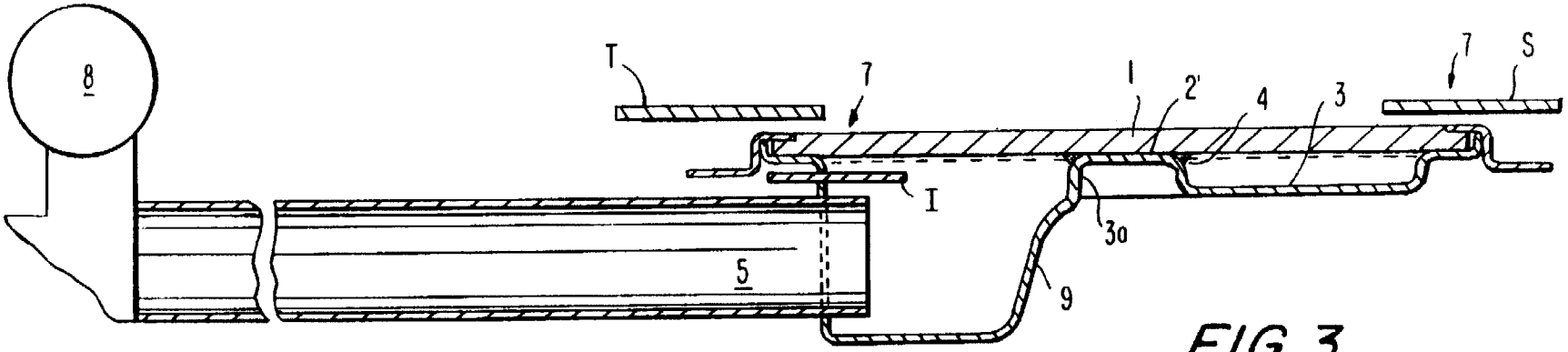
FIG. 3 is a cross-sectional view through an additional embodiment of a gas burner according to the invention.

FIG. 3 shows a third embodiment of a gas burner according to the invention including a burner plate 1 and a vibration damping means 2' on which a central region C' of the burner plate 1 contacts or rests. In this embodiment the damping means 2' comprises a recessed portion 3*a* of the base plate 9 of the burner chamber housing 3. The burner plate 1 is then attached to the recessed portion 3*a* in the middle the base plate 9 by portions 4 of a temperature-resistant adhesive.

Burner plates used in the invention are made from SiC fibers (Nicalon®, Nippon Carbon or Tyranno®, UBE Industries) of thickness 15 μm, which are bonded with each other into a molded body in a CVD-process with SiC. These burner plates can be purchased, e.g., from Global Environmental Solutions, San Clemente, Calif. These burner plates have a thickness of 4 mm, a diameter of 145, 180 or 210 mm, and a porosity of 90%.

The gas burner according to the invention practically completely suppresses sound generation during start up of the burner and among other thereby things avoids a pressure drop which would otherwise require a more powerful air blower.

As in many conventional burners the burner chamber housing 3 is attached to the burner plate 1 at edge regions 7 of the burner plate 1. A mixing pipe 5 is connected to the burner chamber housing 3 for supply of a gas/air mixture to the burner plate 1 and a blower 8 for supplying air to the mixing pipe 5 is provided. In some embodiments an igniter I, a safety device S and/or a temperature monitoring device T may be provided.

The subject matter of German Patent Application 195 45 504.5-13, of Dec. 6, 1995, is the incorporated here by reference. Priority rights for the instant invention are based on the disclosure in this German Patent Application.

While the invention has been illustrated and described as embodied in a gas burner having a burner plate made of fibrous material and reduced sound generation, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

1. A gas burner comprising a burner chamber housing, a mixing pipe connected to the burner chamber housing for supply of a gas/air mixture, a burner plate made of fibrous material and having edge regions, said burner chamber housing being attached to the burner plate at said edge regions, a blower for supplying air, and means for suppressing burner plate vibration and resulting sound generation;

wherein said means for suppressing comprises means for attaching a central region of said burner plate to said burner chamber housing and said means for attaching a central region of said burner plate to said burner chamber housing comprises a recessed portion formed in a middle region of a base plate of said burner chamber housing, said recessed portion being shaped to contact said burner plate, and at least one portion of a temperature-resistant adhesive connecting said burner plate and said recessed portion of said burner chamber housing.

2. The gas burner as defined in claim 1, wherein said means for attaching a central region of said burner plate to said burner chamber housing comprises a damping member contacting said central region of said burner plate and said burner chamber housing, and at least one portion of a temperature-resistant adhesive connecting said damping member with at least one of said burner plate and said burner chamber housing, wherein said damping member is made from a material selected from the group consisting of ceramics, ceramic-fibers, glass and metals.

3. The gas burner as defined in claim 1, wherein the burner plate is made from temperature-resistant fiber and said temperature-resistant fiber is selected from the group consisting of SiC fiber, metal fiber and $Al_2O_3$—$SiO_2$ fibers.

4. The gas burner as defined in claim 1, further comprising at least one of an ignition device, a safety device and a temperature monitoring device.

* * * * *